US005161318A

United States Patent [19]

Bergman et al.

[11] Patent Number: 5,161,318

[45] Date of Patent: Nov. 10, 1992

[54] POWER SWEEPING TOOL

[76] Inventors: Ronald E. Bergman, 613 W. Pine Cir., Bottineau, N. Dak. 58318; Paul G. Sund, R.R. 1, Box 40, Upham, N. Dak. 58789

[21] Appl. No.: 729,063

[22] Filed: Jul. 12, 1991

[51] Int. Cl.[5] ..... E01H 5/04; E01H 5/09

[52] U.S. Cl. ..... 37/233; 37/246; 37/259; 37/244

[58] Field of Search ..... 37/285, 244, 246, 259, 37/233, 223

[56] References Cited

U.S. PATENT DOCUMENTS

| | | | |
|---|---|---|---|
| 1,439,832 | 12/1922 | Merrill . | |
| 2,132,465 | 10/1938 | Gast . | |
| 2,148,841 | 2/1939 | Senior . | |
| 2,171,075 | 8/1939 | Blazier | 37/285 X |
| 2,633,789 | 4/1953 | Ober . | |
| 2,974,471 | 3/1961 | Murphy . | |
| 3,045,267 | 7/1962 | Wagner . | |
| 3,106,733 | 10/1963 | Le Counte et al. . | |
| 3,340,626 | 9/1967 | Konucik . | |
| 3,603,162 | 9/1971 | Gohler . | |
| 3,758,967 | 9/1973 | Thompson . | |
| 3,783,592 | 1/1974 | Schraut . | |
| 4,064,679 | 12/1977 | Spinner . | |
| 4,190,972 | 3/1980 | Berner | 37/285 X |
| 4,255,880 | 3/1981 | McMickle et al. | 37/285 X |
| 4,295,285 | 10/1981 | Stevens | 37/246 |
| 4,329,792 | 5/1982 | Berner | 37/246 |
| 4,602,400 | 7/1986 | Agergard et al. . | |
| 4,893,368 | 1/1990 | Ward . | |
| 4,897,942 | 2/1990 | Klas et al. | 37/244 |
| 4,920,667 | 5/1990 | Dixon | 37/285 |

OTHER PUBLICATIONS

One page brochure published by Stihl, Inc. illustrating a hand held yard care device, published 1987.

Multiple page catalog published by Stihl, Inc. illustrating a variety of hand-held tools, date unknown.

A parts list published by Stihl, Inc. for Stihl Cultivator BC 40, published 1990.

*Primary Examiner*—Randolph A. Reese

*Assistant Examiner*—J. Russell McBee

*Attorney, Agent, or Firm*—Moore & Hansen

[57] ABSTRACT

The present invention provides a hand held, readily portable power sweeping tool. The tool includes an elongate boom having a power generation means disposed at one end thereof and a power sweeping means disposed at the other end. Power transmission means extends between the power generation means and the power sweeping means for transmitting power generated by the power generation means to the sweeping means. The sweeping means comprises a pair of drums mounted for rotation by the power transmission means, the drums including a plurality of pliant fins extending radially outwardly therefrom.

26 Claims, 3 Drawing Sheets

POWER SWEEPING TOOL

The present invention relates in general to power sweeping tools and in particular to a light-weight, hand-held powered tool for removing snow and debris from sidewalks, driveways, decks, roofs, lawns or other surfaces.

BACKGROUND OF THE PRESENT INVENTION

Traditionally, snow removal equipment has included wheeled vehicles either pushed or self-propelled that throw snow in a desired direction, generally transverse to the direction of travel. This equipment is often quite heavy and is therefore generally quite cumbersome to use since it is not easily maneuverable and particularly so when the snowfall is minimal. The utility of this equipment is also limited generally to snow removal only and does not include general debris removal.

Powered sweepers, such as that disclosed in U.S. Pat. No. 4,602,400 to Agergard et al., are also known in the art. Generally they comprise a wheeled vehicle having a cylindrical brush rotatably driven by a gas engine. These devices can also be cumbersome to use and are not preferred for snow removal. Such sweepers, like snow blowers, can be difficult for the elderly to use because of their size and can be difficult to move onto a deck for snow or other debris removal. Additionally, sometimes snow and debris removal from roofs, particularly flat roofs, is necessary. Moving such conventional snow or debris removal equipment to a roof is generally impractical for most individuals, assuming the roof could support the weight of such equipment.

Equipment utilizing pressurized air to move debris is known in the art. Typically these are hand-carried devices that shoot a pressurized stream of air in a generally desired direction. These devices are used to blow leaves in lieu of raking and to clear walks and drives. They could be useful for some snow removal, but not when the snow is wet and heavy since the flakes adhere to each other and the pressurized airstream is insufficient to move it. Thus, the usefulness of this tool is also limited.

It would be desirable to have snow removable equipment that was light enough to be hand held, that was readily portable and that was capable of handling snow falls—wet or dry—of up to several inches in depth. It would further be desirable if such equipment were operable to remove general debris, such as sand, small rocks and leaves or other like debris from walkways, driveways, roofs, decks or other surfaces.

SUMMARY OF THE PRESENT INVENTION

The present invention provides a readily portable hand held power sweeping tool useful for removal of snow and debris such as leaves, sand, dirt, small rocks and the like from sidewalks, driveways, decks, roofs or similar surfaces, as well as from lawns without damage to the grass. The tool has an elongate boom having a power generation means disposed at one end thereof and a sweeping means at the other end. Power transmission means extend between the power generation means and the sweeping means to provide power to the sweeping means. The power transmission means includes a pair of stub drive shafts extending transversely to and outwardly from the boom in opposite directions. The sweeping means comprises a pair of sweepers, one attached to each drive shaft. Each sweeper includes a cylindrical support means having an attachment means for affixing the support means to a drive shaft so that the sweeper rotates synchronously therewith. Each sweeper further includes a belt means having substantially outwardly extending pliant sweeping fins. The belt means may be a one piece article whose free ends are attached together around the support means to form the cylindrical sweeper or may include a plurality of smaller belt sections whose free ends are attached together to form a single belt.

Operationally, each sweeper is rotated by the power generator means and operates to push against and move material such as snow and debris that has collected on a surface whose cleaning is desired from that surface to another location.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE PRESENT INVENTION

Figure 1:
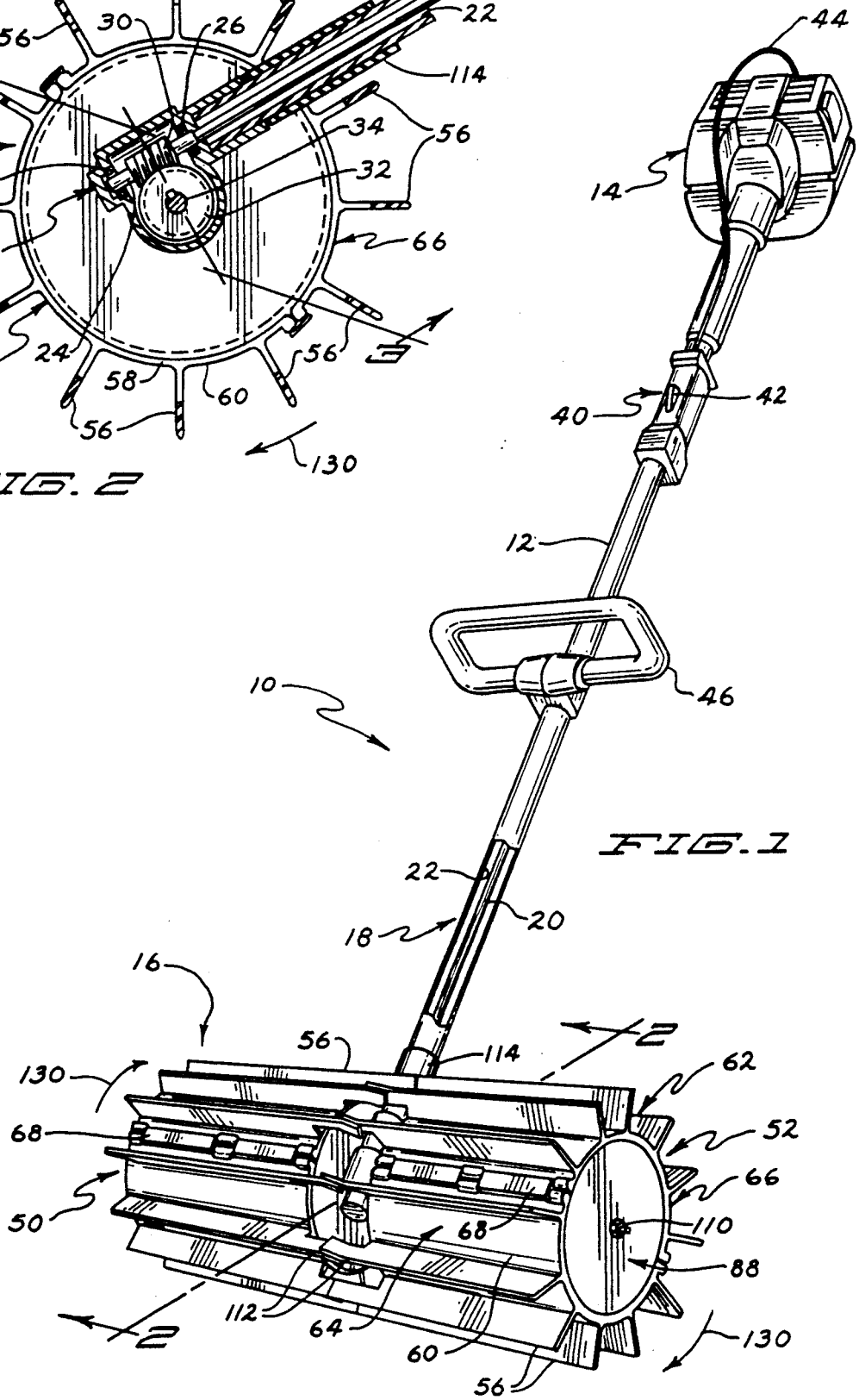
FIG. 1 is a perspective view of an embodiment of a power sweeping tool as described and claimed herein.

FIG. 1 shows a hand held power sweeping tool 10 in accordance with the present invention. Tool 10 includes an elongate boom 12 having a power generation means 14 attached at one end thereof and a power sweeping means 16 disposed at the other end thereof. Power generation means 14 may be a gas or electric motor as known in the art. Boom 12 further includes a power transmission means 18 for transmitting power generated by means 14 to sweeping means 16. Power transmission means 18 includes a rotatable shaft 20 contained internally of boom 12 in a sleeve 22.

Figure 2:
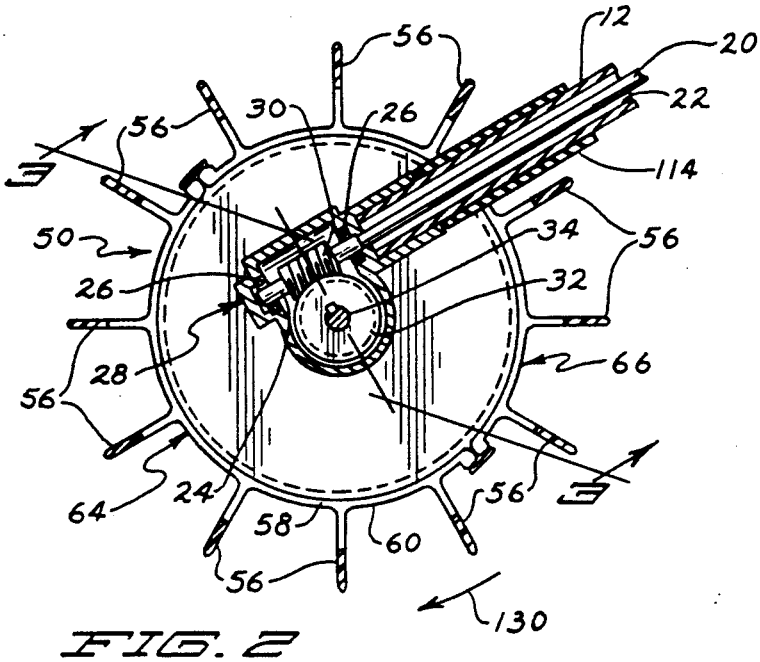
FIG. 2 is a cross sectional view of a portion of the power transmission means and power sweeping tool of FIG. 1 taken along cutting plane 2—2.
Figure 3:
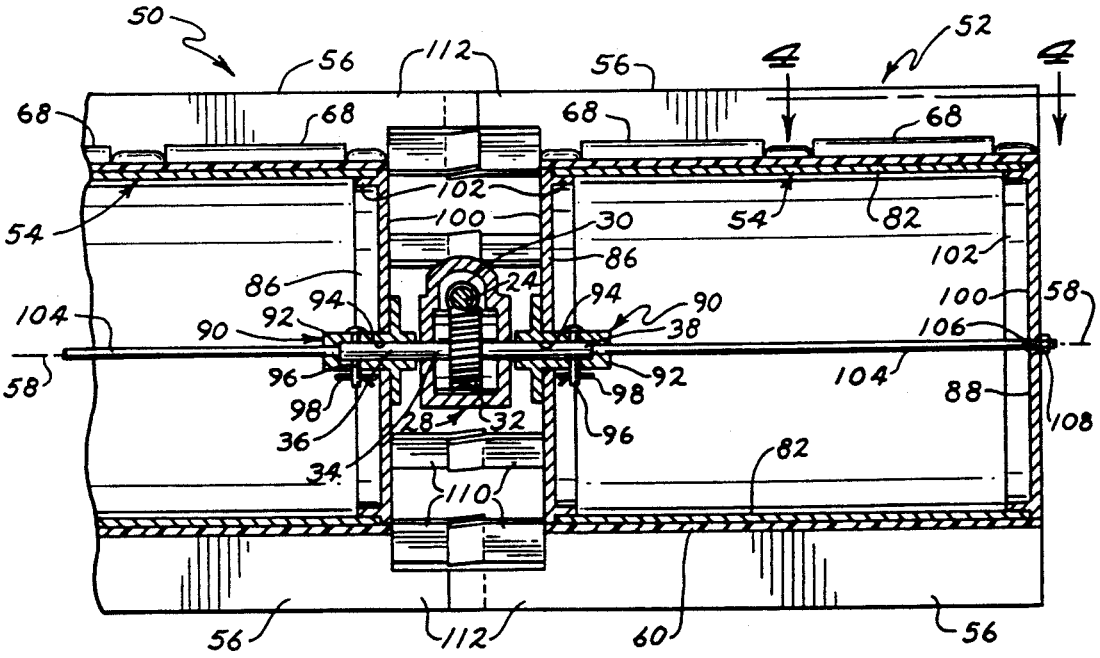
FIG. 3 is a cross sectional view of the power transmission means and a partial view of the power sweeping means taken along cutting plane 3—3 of FIG. 2.

Referring now to FIGS. 2 and 3 particularly, a first end of shaft 20 is rotatably engaged (not shown) by power generation means 14 in a known manner. The other end 24 of shaft 20 is mounted by appropriate bearings 26 contained within a differential 28. Shaft end 24 includes a worm 30 that engages a worm gear 32. Worm gear 32 is attached to a drive shaft 34 having shaft ends 36 and 38 that extend laterally outwardly of differential 28. Shaft ends 36 and 38 of drive shaft 34 function as stub drive shafts as will be clear from the following descriptions. Thus, together worm 30 and worm gear 32 change the direction of power transmission from a direction parallel to boom 12 to a direction 90° therefrom. Power transmission means 18 may further include a throttle means 40 having a trigger means (not shown) to control the power output of power generation means 14 and a thumb or hand actuated safety engagement switch 42. The trigger means communicates by a throttle wire 44 with power generation means 14 where power generation means 14 is a gas powered engine. Where means 14 is an electric motor, the trigger means will act as a rheostat and wire 44 will carry an electrical signal. For convenience, a handle 46 may be attached to boom 12 with tool 10 to facilitate carrying and movement of the tool as desired.

Referring now FIGS. 1–3 in particular power sweeping means 16 comprises a pair of sweepers 50 and 52 attached to shaft ends 36 and 38 of drive shaft 34 respectively. Each sweeper is substantially identical to the other. Thus, it will be understood that a description of sweeper 52 will also describe sweeper 50. Thus, sweeper 52 includes a cylindrical support means 54 supporting a plurality of sweeper fins 56. Fins 56 project substantially radially outwardly from cylindrical support means 54. As shown, fins 56 are disposed at substantially 90° angles to boom 12 and parallel to the longitudinal axis 58 of the sweeper means 16, which is coincident with the axis of drive shaft 34. Sweeper fins 56 may be disposed at a slight angle to axis 58 if desired.

Figure 4:
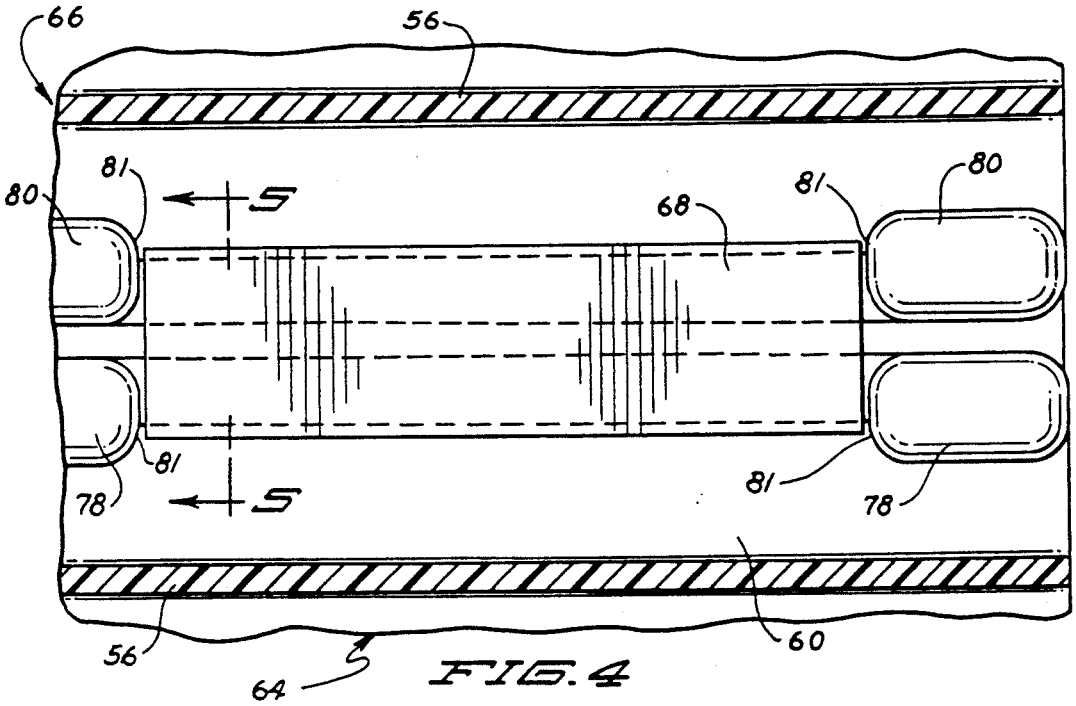
FIG. 4 is a top plan view partially in cross section showing a means for attaching a pair of adjacent free belt ends to each other.
Figure 5:
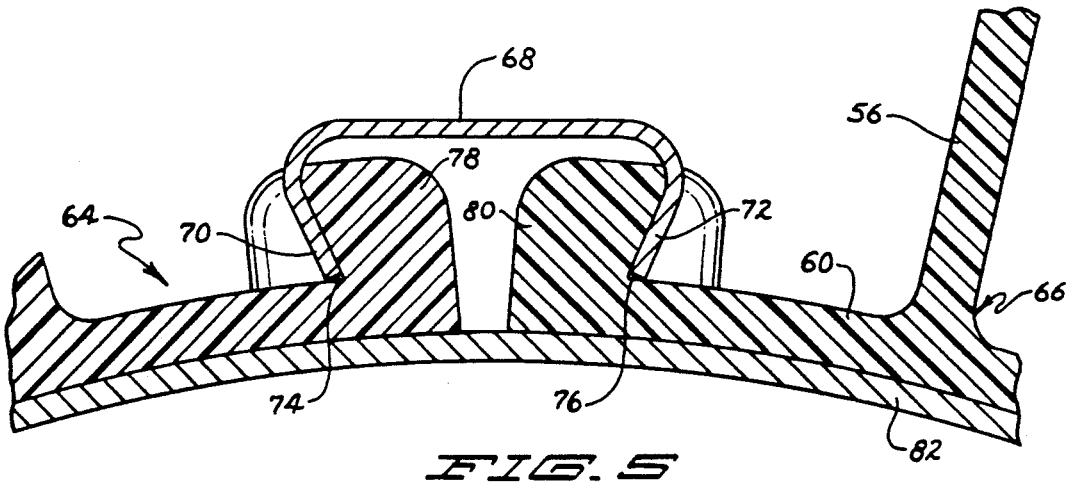
FIG. 5 is a cross section view of the belt end attachment shown in FIG. 4 taken along cutting plane 5—5 thereof.

In the embodiment shown, sweeper fins 56 are attached to a belt carcass 60, together forming a belt 62. As shown in the Figures, belt 62 is comprised of a plurality of individual belt sections 64 and 66 that are attached at their adjacent ends to form a single continuous belt. Belt section 64 and 66 are attached at their adjacent free ends by a C-clip 68 whose free ends 70 and 72 engage recessed slots 74 and 76, respectively, in outward belt projections 78 and 80 disposed along the edges of belt sections 64 and 66, respectively, all as best seen in FIGS. 4 and 5. The C-clip 68 is restrained from longitudinal movement by projection ends 81, best seen in FIG. 4. C-clip 68 is crimped such that ends 70 and 72 are pulled together, thereby pulling the free ends of the belt sections together. Thus, as the ends of the belt sections are attached to one another, the belt is tightened around cylindrical support means 54 so as to achieve a friction fit thereon and to rotate with means 54.

In the embodiment shown in FIGS. 1–5, cylindrical support means 54 of sweeper 52 comprises a cylinder or drum 82 whose open ends 84 are closed by affixed end caps 86 and 88. Inner end cap 86 includes a centrally disposed shaft receiving means 90. Means 90 includes a hub 92 having a central bore 94 for receiving shaft end 38. Preferably, both hub 92 and its received shaft end 38 include mutually alignable through holes for receiving a retaining pin 96 to rigidly attach sweeper 52 to shaft end 38 for rotation therewith. Pin 96 is retained by means of a key 98 insertable through a through hole in the end thereof in a known manner.

As noted, sweeper 50 is substantially similar to sweeper 52 and the description just provided of the cylindrical support means 54 and its attachment to shaft end 38 is descriptive of the cylindrical support means 54 of sweeper 50 and its attachment to shaft end 36. Sweeper means 50 and 52 are interchangeable and thus the aforesaid attachment descriptions also suffice to describe a reversed attachment wherein sweeper 50 is attached to shaft end 38 and sweeper 52 is attached to shaft end 36.

Figure 6:
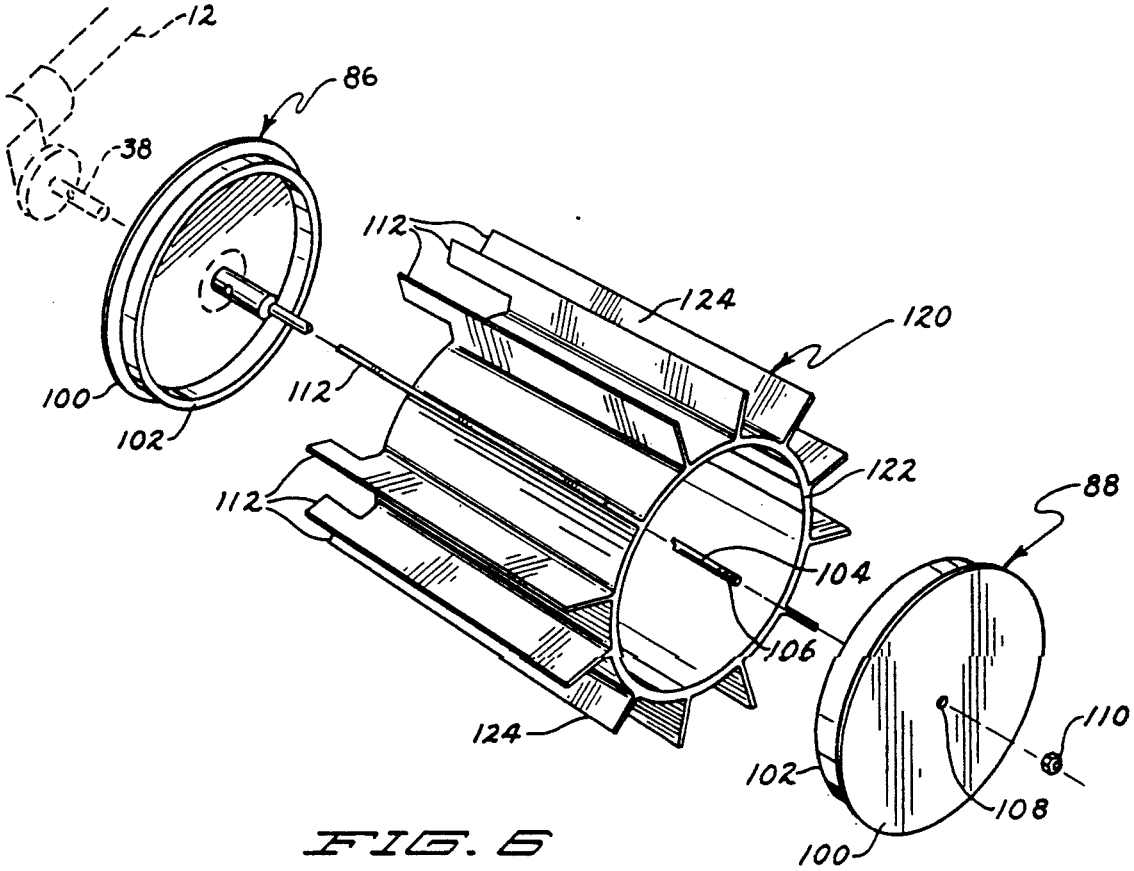
FIG. 6 shows an alternate embodiment of the sweeping means.

The configuration of end caps 86 and 88 is best seen in FIG. 6. Each end cap includes a disk-shaped portion 100 to which an annular rim 102 is attached. In the embodiment shown in FIG. 3, annular rim 102 has an outer diameter substantially equal to the inner diameter of cylinder 82 so as to be snugly received thereby in a friction fit. Annular rim 102 further aids cylinder 82 in maintaining its cylindrical shape during operation by outwardly supporting the wall of cylinder 82. A support rod 104 extends along longitudinal axis 58 of cylindrical support means 54 between shaft receiving means 92 and disk 100 of end cap 88. Rod 104 has a threaded outer end 106 that extends through a centrally located opening 108 of end cap 88 and receives a threaded fastener 110 to rigidly attach end caps 86 and 88 together.

In the preferred embodiment seen in FIGS. 1–5, fins 56 on sweepers 50 and 52 include inwardly extending fin segments 112 that extend inwardly towards boom 12 in overlapping engagement with each other. In FIG. 2, the fin segments 112 of sweeper 52 have been eliminated for clarity of illustration. Preferably, the fin extensions 112 have a length substantially equal to or greater than the distance between the inner end cap 86 of its respective cylindrical support means and the center of boom 12. A pair of adjacent fins thus extends substantially across the gap between support means 54 of sweepers 50 and 52. Fin extensions 112 of sweeper 50 and sweeper 52 are shown physically engaged with each other in FIGS. 1 and 3 and such engagement is generally preferred, though the fins 56 of sweepers 50 and 52 may be offset so as to not form a substantially straight line and such an embodiment is within the purview of the present invention. As best seen in FIGS. 1 and 3, fin extensions 112 provide the ability to sweep a substantially complete, continuous swath equal to the width of sweeping means 16.

Fin extensions 112 are formed of a flexible material as are the rest of fins 56, and, because of their length, they will strike boom 12 during rotation. To prevent excessive wear to boom 12 and/or to fin extensions 112, boom 12 may include a wear collar 114 made of hard rubber, plastic or any wear-resistant material. Wear collar 114 has a substantially cylindrical configuration as shown to conform to the configuration of boom 12 and to surround boom 12 where contact between the boom and the fin segments 112 would occur. Collar 114 may have other configurations but preferably has a smoothly contoured outer surface to reduce wear to fin segments 112. Collar 114 may fit loosely about boom 12 or may be affixed thereto by known means such as gluing, bolting, or welding, dependent upon the type of material used for collar 114.

Without fin extensions 112, an unswept swath equal to the distance between inner end caps 86 of sweepers 50 and 52 would be left during a sweeping operation. That is, with the present invention, an operator is able to sweep an uninterrupted swath substantially equal to the width of sweeping means 16. A tool 10 having no fin segments 112 or fin segments having a length less than the distance between the center of boom 12 and the inner end cap 86 is also within the purview of the present invention.

An alternative embodiment to the present invention is shown in FIG. 6 wherein a unitary belt 120 comprises a belt carcass 122 from which a plurality of flexible fins 124 extend. Belt carcass 122 is made of a sufficiently stiff material that cylinder 82 is not required in order to maintain the cylindrical configuration of the belt. In this embodiment then, end caps 86 and 88 serve as cylindrical support means. Belt carcass 122 may be frictionally engaged on annular disk portions 102 such that it will rotate with stub drive shafts 36 and 38 or mounted thereto using other means known in the art.

The present invention as described provides a general purpose, readily portable, hand held sweeping tool. It is useful for sweeping small rocks, wood chips, leaves, snow, cans and bottles, from driveways, sidewalks, decks, roofs, lawns or other surfaces, including interior floors where debris may be found. As seen in FIGS. 1 and 2, when held in the operating position shown in FIG. 1, sweeper means 16 generally rotates in a clockwise fashion as indicated by arrow 130. This direction of operation is useful when it is desired to push debris ahead of the operator. However, due to the portable, hand held nature of tool 10, the tool may be inverted such that sweeping means 16 is rotating in a counterclockwise direction. In such a mode of operation, handle 46 would be disposed underneath boom 12 rather than above it as shown in FIG. 1. When so held, tool 10 is useful for pulling debris away from structures or fences; it may then be inverted to the operating position shown in FIG. 1 to sweep debris ahead of the operator. The flexible fins used on tool 10 are not harmful to the surfaces they contact, particularly grass. This makes tool 10 useful for sweeping debris that may have fallen upon a lawn, such as leaves or trash. A further advantage of tool 10 is that it is easily portable. Thus, it is readily moved onto a deck or carried onto a roof when needed to remove snow or other debris therefrom. Tool 10 has the further advantage that once it has been lifted, no further lifting effort is required. Thus, unlike snow removal by hand where a shovel is used tool 10 may be carried in a single position and the snow removed from a surface by pushing it ahead of the operator as he moves forward.

The present invention having thus been described, other modifications, alterations, or substitutions may now suggest themselves to those skilled in the art, all of which are within the spirit and scope of the present invention. For example, cylindrical support means 54 may include a cylindrical structure formed by the cylindrical arrangement of individual elongate members or sweeper means 50 and 52 may be manufactured separately from the remainder of tool 10 and sold as a quick and readily attachable accessory or as replacement for previously sold devices. It is therefore intended that the present invention be limited only by the scope of the attached claims below.

We claim:

1. A hand held, readily portable power sweeping tool comprising:

an elongate boom;

power generation means disposed at one end of said boom;

sweeping means disposed at the other end of said boom; and power transmission means extending between said power generation means and said sweeping means for transmitting power generated by said power generation means to said sweeping means, said power transmission means including first and second stub drive shafts extending transversely to and outwardly from said boom in opposite directions;

wherein said sweeping means comprises:

first and second sweepers, each sweeper including a cylindrical support means, each said support means including a mounting means for affixing one of said sweepers to one of said drive shafts so that said sweepers rotate with said drive shafts, each said sweeper further including a sweeper belt means attached around said cylindrical support means for rotation therewith, said sweeper belt means having a plurality of outwardly extending pliant fins.

2. The tool of claim 1 wherein said fins of each said sweeper belt includes inner segments extending laterally beyond said support means inwardly toward said boom so as to provide substantially continuous fins over the entire width of said sweeping means so that said tool sweeps a continuous swath substantially equal to the width of said sweeping means.

3. The tool of claim 2 and further including a wear reducing means surrounding said boom where said fin segments would strike said boom during rotation of said sweepers, said wear reducing means being provided to reduce abrasive wear to said boom.

4. The tool of claim 2 wherein the length of said fin segments is substantially equal to or greater than the distance between the inner end of its respective cylindrical support means and the center of the boom.

5. The tool of claim 1 wherein:

at least one of said cylindrical support means comprises a drum having a first end closed by an attachment cap, and said mounting means comprising receiving means on said attachment cap for one of said drive shafts.

6. The tool of claim 5 wherein said drum has a longitudinal axis and the other end of said drum is closed by a cap snugly insertable therein, and wherein said drum further includes a rod, said rod extending internally of said drum along the axis thereof from said receiving means to said cap and being affixed thereto.

7. The tool of claim 6 wherein said cap has a centrally located aperture and said rod has a threaded end extending through said aperture in said cap and wherein said rod is held in place by a threaded fastener that threadably engages said threaded end.

8. The tool of claim 5 wherein said receiving means comprises a hub having a shaft receiving bore for snugly receiving said stub drive shaft, said hub and said stub drive shaft each having a transverse hole therethrough, said transverse holes being capable of being aligned when said drive shaft is received within said receiving bore, said sweeper being retained relative to said drive shaft for rotation therewith by a retaining pin inserted through said aligned through holes.

9. The tool of claim 1 wherein said mounting means comprises a hub having a shaft receiving bore for snugly receiving said stub drive shaft, said hub and said stub drive shaft each having a transverse hole therethrough said transverse holes being capable of being aligned when said drive shaft is received within said receiving bore, said sweeper being retained relative to said drive shaft for synchronous rotation by a retaining pin inserted through said aligned through holes.

10. The tool of claim 1 wherein said stub drive shafts extend outwardly from and transversely to said boom along a common axis of rotation.

11. A sweeper means attachment for attachment to a portable tool that comprises an elongate boom, a power generation means disposed at one end of the boom, and a power transmission means extending between the power generation means and the other end of the boom for transmitting power generated by the power generation means to other end of the boom ,the power transmission means including first and second stub drive shafts extending transversely to and outwardly from the other end of the boom in opposite directions, wherein said sweeper means attachment comprises:

first and second sweepers, each sweeper including a cylindrical support means, each said support means including a mounting means for affixing one of said sweepers to one of the stub drive shafts so that said sweepers rotate with the stub drive shafts, each said sweeper further including a sweeper belt means attached around said cylindrical support means for rotation therewith, said sweeper belt means having a plurality of outwardly extending pliant fins.

12. The attachment of claim 11 wherein said fins of each said sweeper belt includes inner segments extending laterally beyond said support means inwardly toward the boom so as to provide substantially continuous fins over the entire width of said attachment so that said attachment sweeps a continuous swath substantially equal to the width thereof.

13. The attachment of claim 12 wherein the length of said fin segments is substantially equal to or greater than the distance between the inner end of its respective cylindrical support means and the center of the boom.

14. The attachment of claim 11 wherein:

at least one of said cylindrical support means comprises a drum having a first end closed by an attachment cap and said mounting means comprises receiving means on said attachment cap for one of the stub drive shafts.

15. The attachment of claim 14 wherein said drum has a longitudinal axis and the other end of said drum is closed by a cap snugly insertable therein, and wherein said drum further includes a rod, said rod extending internally of said drum along the axis thereof from said receiving means to said cap and being affixed thereto.

16. The attachment of claim 15 wherein said cap has a centrally located aperture and said rod has a threaded end extending through said aperture in said cap and wherein said rod is held in place by a threaded fastener that threadably engages said threaded end.

17. The attachment of claim 14 wherein said mounting means comprises a hub having a shaft-receiving bore for snugly receiving the stub drive shaft, said hub and the stub drive shaft each having a transverse hole therethrough, wherein said transverse hole of said hub is capable of being aligned with the transverse hole of the stub drive shaft when the stub drive shaft is received within said receiving bore, said sweeper being retained relative to the stub drive shaft for synchronous rotation by a retaining pin inserted through the aligned through holes.

18. The attachment of claim 11 wherein said mounting means comprises a hub having a shaft receiving bore for snugly receiving the stub drive shaft, said hub and the stub drive shaft each having a transverse hole therethrough, wherein said transverse hole of said hub is capable of being aligned with the transverse hole of the stub drive shaft when the stub drive shaft is received within said receiving bore, said sweeper being retained relative to the stub drive shaft for synchronous rotation by a retaining pin inserted through the aligned through holes.

19. The attachment of claim 11 wherein the stub drive shafts extend outwardly from and transversely to the boom along a common axis of rotation.

20. A sweeper means attachment, said sweeper means attachment being provided for attachment to a tool that comprises power generation means, at least one drive shaft, and power transmission means extending between the power generation means and the drive shaft for transmitting power generated by the power generation means to the drive shaft, wherein said sweeper means attachment comprises:

a sweeper, said sweeper including a cylindrical support means, said support means including a mounting means for affixing said sweeper to said drive shaft so that said sweeper rotates with the drive shaft, said sweeper further including a sweeper belt means attached around said cylindrical support means for rotation therewith, said sweeper belt means having a plurality of outwardly extending pliant fins.

21. The attachment of claim 20 wherein said fins of each said sweeper belt includes segments extending laterally beyond said support means.

22. The attachment of claim 20 wherein:

said cylindrical support means comprises a drum having a first end closed by an attachment cap and said mounting means comprises receiving means on said attachment cap for the drive shaft.

23. The attachment of claim 22 wherein said drum has a longitudinal axis and the other end of said drum is closed by a cap snugly insertable therein, and wherein said drum further includes a rod, said rod extending internally of said drum along the axis thereof from said receiving means to said cap and being affixed thereto.

24. The attachment of claim 23 wherein said cap has a centrally located aperture and said rod has a threaded end extending through said aperture in said cap and wherein said rod is held in place by a threaded fastener that threadably engages said threaded end.

25. The attachment of claim 22 wherein said mounting means comprises a hub having a shaft-receiving bore for snugly receiving the drive shaft, said hub and the drive shaft each having a transverse hole therethrough, wherein said transverse hole of said hub is capable of being aligned with the transverse hole of the drive shaft when the drive shaft is received with said receiving bore, said sweeper being retained relative to the drive shaft for synchronous rotation by a retaining pin inserted through the aligned through holes.

26. The attachment of claim 20 wherein said mounting means comprises a hub having a shaft receiving bore for snugly receiving the drive shaft, said hub and the drive shaft each having a transverse hole therethrough, wherein said transverse hole of said hub is capable of being aligned with the transverse hole of the drive shaft when the drive shaft is received within said receiving bore, said sweeper being retained relative to the drive shaft for synchronous rotation by a retaining pin inserted through the aligned through holes.

* * * * *